United States Patent [19]

Howard

[11] Patent Number: 4,786,097

[45] Date of Patent: Nov. 22, 1988

[54] SKI AND SKI POLE CARRYING HANDLE

[75] Inventor: Joe D. Howard, Bethany, Okla.

[73] Assignee: Nancy J. Cornett, Bethany, Okla.

[21] Appl. No.: 116,852

[22] Filed: Nov. 5, 1987

[51] Int. Cl.[4] ..... A63C 11/02

[52] U.S. Cl. ..... 294/147; 280/814; 294/166

[58] Field of Search ..... 294/146–148, 294/151, 153, 154, 157, 159, 161–163, 165, 166; 211/70.5; 224/917; 280/814, 815

[56] References Cited

U.S. PATENT DOCUMENTS

| | | | |
|---|---|---|---|
| 3,370,766 | 2/1968 | Woolworth | 294/147 |
| 3,626,553 | 12/1971 | Darney et al. | 294/147 X |
| 3,718,242 | 2/1973 | Larson | 294/147 |
| 3,877,623 | 4/1975 | Breault | 294/147 |
| 4,190,182 | 2/1980 | Hickey | 294/147 |
| 4,310,190 | 1/1982 | Schuetzeberg et al. | 294/147 |
| 4,460,207 | 7/1984 | Gies | 294/147 |

FOREIGN PATENT DOCUMENTS

| | | | |
|---|---|---|---|
| 2535224 | 2/1977 | Fed. Rep. of Germany | 294/147 |
| 3434958 | 4/1986 | Fed. Rep. of Germany | 280/814 |

*Primary Examiner*—Johnny D. Cherry
*Attorney, Agent, or Firm*—Robert K. Rhea

[57] ABSTRACT

A hand carrier for skis and a pair of ski poles comprising a unitary generally rectangular planar body provided with a transverse aperture forming a handle at one side thereof. The body portion opposite the handle is provided with a laterally open coextensive groove on its opposing sides for nesting an intermediate portion of each ski of a pair of skis. Resilient strap members, extended through the handle forming opening and transversely around the body and skis, overlap and secure the skis to the body. Pairs of outstanding clips, on opposing sides of the body adjacent the handle, resiliently support a pair of ski poles.

2 Claims, 1 Drawing Sheet

SKI AND SKI POLE CARRYING HANDLE

BACKGROUND OF THE INVENTION

1. Field of the Invention

The present invention relates to hand held carriers and more particularly to a unitary relatively small handle equipped unit for attaching a pair of skis and ski poles thereto.

Skis and ski poles, principally because of their dimensions, are not easily carried or packed with luggage. Furthermore, it is desirable to provide a device which, in addition to joining a pair of skis and a pair of ski poles in a compact manner, provides a means for easily storing and transporting the skis and poles as a unit.

2. Description of the Prior Art

The prior art discloses a number of patents for storing and carrying skis and/or poles in which most of the devices disclosed are formed from several cooperating components hinged or pivotally connected together in a manner to be moved to an open position for accepting the skis and then folded to a ski securing position. The complexity of these devices adds to the cost of manufacture and they are, therefore, relatively expensive.

The most pertinent prior patent is believed to be U.S. Pat. No. 4,190,182 which discloses a two-part base portion substantially describing opposing upwardly open channels for respectively receiving an intermediate portion of a pair of skis. The base channels are interdigitatedly joined with an upstanding handle portion in hinged fashion for lateral pivoting movement of the handle relative to the base. The handle is further provided with opposing resilient clamps supporting a pair of ski poles at opposite sides of the handle.

This invention is distinctive over this patent and other prior devices by providing a unitary handle member releaseably binding skis and ski poles to opposing sides thereof by resilient members.

SUMMARY OF THE INVENTION

A generally planar rectangular body is provided with oppositely disposed grooves extending longitudinally of its respective sides for nesting intermediate portions of a pair of skis. An aperture in the body opposite the skis forms a handle. Elongated resilient members projecting through the handle forming aperture surround an intermediate portion of the skis and bind them to the body. Pairs of outstanding resilient clips on respective opposite sides of the body removably receive intermediate portions of a pair of ski poles in supporting relation.

The principal objects of this invention are to provide a unitary body having a handle and oppositely disposed recesses nesting and supporting a pair of skis by resilient means binding the skis to the body and clip members gripping ski poles and providing a cable and lock receiving arrangement for securing the handle, skis and ski poles as a unit to a stationary object.

DESCRIPTION OF THE PREFERRED EMBODIMENTS

Figure 1:
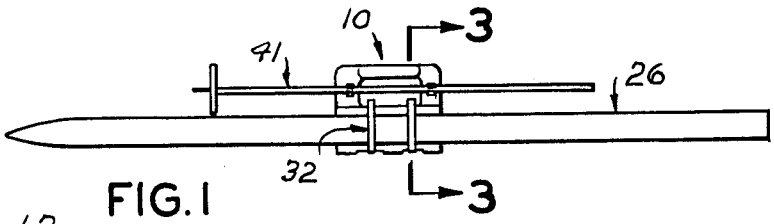
FIG. 1 is a side elevational view of the ski handle supporting a pair of skis and ski poles.

Like characters of reference designate like parts in those figures of the drawings in which they occur.

In the drawings:

The reference numeral 10 indicates the device which is generally planar, normally vertically disposed edgewise and generally rectangular in side elevation.

Figure 2:
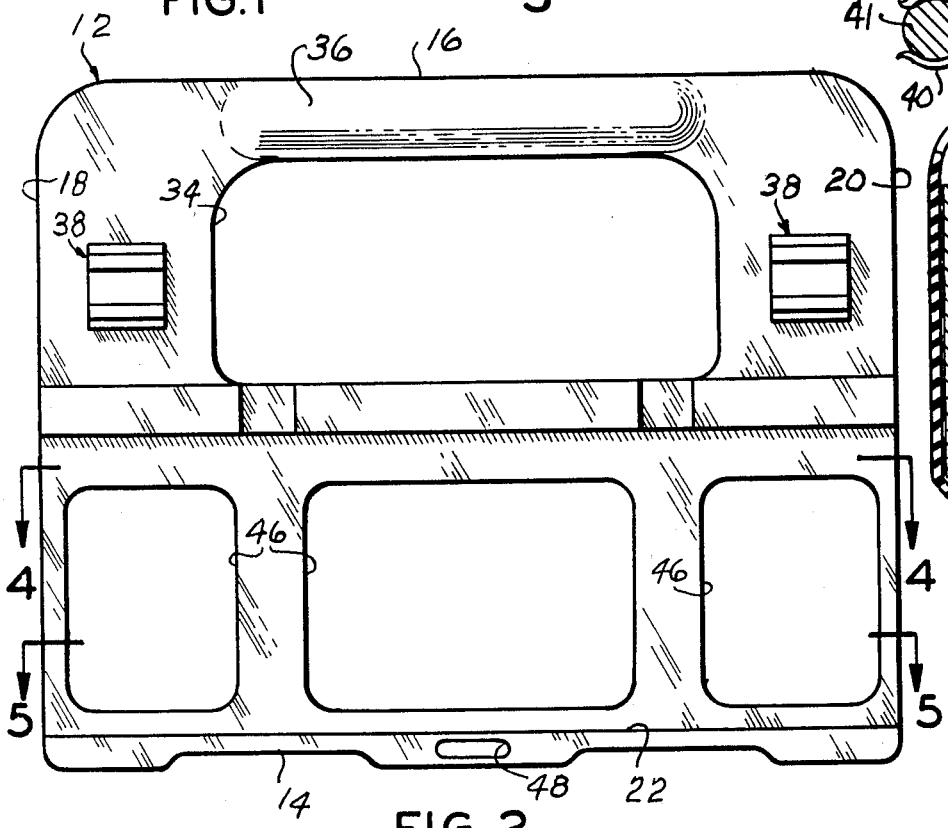
FIG. 2 is a side elevational view, to an enlarged scale, of the ski handle, per se.
Figure 4:
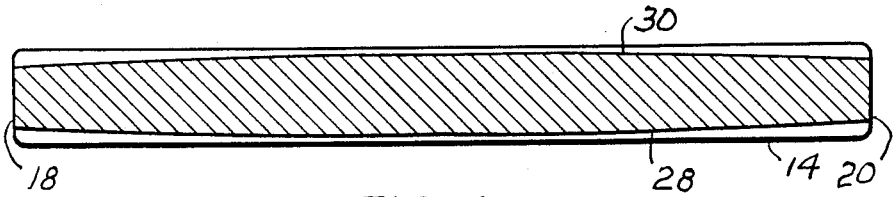
Figure 5:
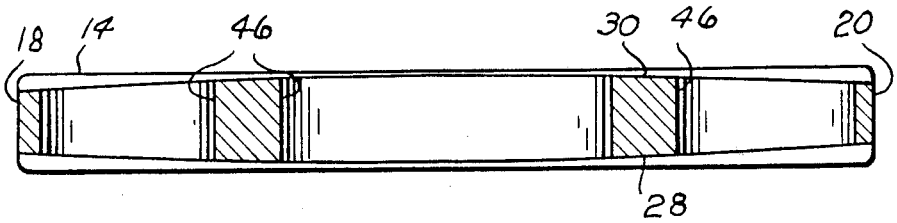

The device 10 comprises a body portion 12 characterized by a bottom or base edge 14 and an upper or top surface 16 parallel with the base edge and generally vertical parallel end surfaces 18 and 20. Opposing lateral surfaces of the depending one-half portion of the body 12, as viewed in FIG. 2, are respectively provided with rectangular grooves 22 and 24 extending, between its respective ends. The depth of the grooves 22, 24 is less than the thickness of the respective ski of a pair of skis 26. The purpose of the grooves 22 and 24 is to flatly nest an intermediate bottom portion of the respective ski. Since each pair of skis are conventionally arcuately curved or bowed upwardly between its ends, the groove bottom surfaces 28 and 30 (FIGS. 4 and 5) respectively defining the bottom of the grooves 22 and 24 is also curved complemental with the curve or bow of the conventional ski so that the bottom surface of the respective ski contiguously contacts the respective groove bottom surface. A pair of elongated strap members 32 secure the pair of skis 26 in the grooves 22 and 24, as presently explained in more detail.

Figure 3:
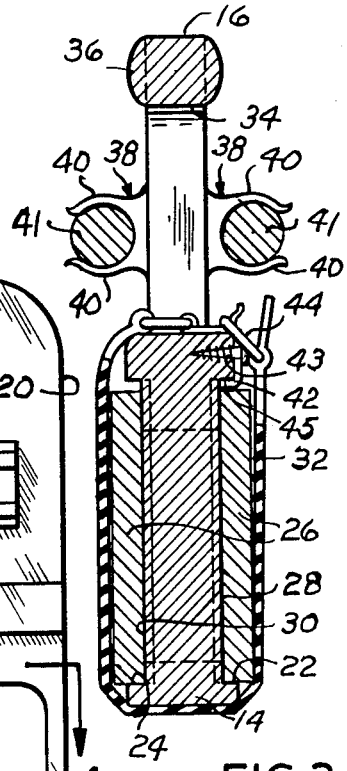
FIG. 3 is a vertical cross sectional view, to another scale, taken substantially along the line 3—3 of FIG. 1; and, FIGS. 4 and 5 are horizontal cross sectional views taken substantially along the lines 4—4 and 5—5 of FIG. 2.

The upper or top half portion of the body 12 is transversely apertured, as at 34, to define a rod-like hand grip or handle 36 adjacent its top surface for manually transporting the device with the pair of skis 26 attached thereto. Additionally, the respective opposing side surface of the upper portion of the body 12 is provided with two pairs of arcuate resilient clips 38 with one clip of each pair located respectively adjacent the respective end of the body. Each clip of each pair of clips is substantially U-shaped in end elevation, as viewed in FIG. 3, with the legs 40 of the respective U-shaped clip projecting generally horizontally in a lateral direction from the respective side surface of the body 12. The purpose of the pairs of clips 38 is to resiliently respectively grip intermediate portions of a pair of ski poles 41.

Each strap of the pair of resilient straps 32 is provided at one end with a substantially L-shaped hook-equipped bracket 42 which cooperatively grips a body shoulder 45 formed by the upper side limit of the groove 22 and secured thereto by a screw 43. The other end portion of the strap is entrained through the handle forming opening 34 and transversely across one ski, the base edge of the body 14 and the other ski. An endless loop 44 on the strap end opposite the bracket 42 is secured by the bracket hook.

The body 12 is further provided with a series, three in the example shown, of transverse lightening apertures 46. Additionally, the body base portion 14 is provided with a base aperture 48 which slidably receives an intermediate portion of an elongated strand, such as a cable, not shown, to be wrapped around or across the pair of skis and ski poles for securing the assembly to a stationary object by a padlock, neither of which are shown.

Obviously the invention is susceptible to changes or alterations without defeating its practicability. Therefore, I do not wish to be confined to the preferred embodiment shown in the drawings and described herein.

I claim:

1. A hand held carrier for a pair of skis, comprising:

handle means including a unitary rectangular planar body having top and bottom surfaces and vertical ends and opposing side surfaces and having a hand opening adjacent its top surface, opposing side surfaces of said body having a coextensive longitudinal groove between the hand opening and its bottom surface, each said groove being characterized by an outwardly bowed elongated convex bottom surface for respectively contiguously contacting the bottom surface of and intermediate portion of each ski of a pair of skis; and, elongated resilient strap means including a fastener on one end thereof secured to said body within the hand opening and tautly surrounding and binding an intermediate portion of a pair of skis to the body when placed within the respective said groove.

2. The ski carrier according to claim 1 and further including:

resilient clip means integrally formed on opposing sides of said body for releaseably gripping a pair of ski poles extending generally parallel with the plane of said body and the longitudinal axes of the skis.

* * * * *